US006723030B1

(12) United States Patent
Chen

(10) Patent No.: US 6,723,030 B1
(45) Date of Patent: Apr. 20, 2004

(54) ANGLE-ADJUSTABLE EXERCISER

(76) Inventor: Yu-Sung Chen, 16, Lane 288, Ta Chu Road, Lu Chu Hsiang, Taoyuan Hsien (TW)

( * ) Notice: Subject to any disclaimer, the term of this patent is extended or adjusted under 35 U.S.C. 154(b) by 0 days.

(21) Appl. No.: 10/410,401

(22) Filed: Apr. 10, 2003

(51) Int. Cl.[7] ..... A63B 22/16

(52) U.S. Cl. ..... 482/146; 482/147; 482/79; 482/80

(58) Field of Search ..... 482/79, 80, 146, 482/147

(56) References Cited

U.S. PATENT DOCUMENTS

D223,113 S * 3/1972 King ..... 482/147
4,787,630 A * 11/1988 Watson et al. ..... 272/146
5,536,226 A * 7/1996 Gordon ..... 482/80
6,413,197 B2 * 7/2002 McKechnie et al. ..... 482/146
6,602,172 B1 * 8/2003 Aigner ..... 482/147

* cited by examiner

*Primary Examiner*—Nicholas D. Lucchesi
*Assistant Examiner*—L. Amerson
(74) *Attorney, Agent, or Firm*—Troxell Law Office PLLC

(57) ABSTRACT

An angle-adjustable exerciser comprises a base, an adjustment disk set and a support plate. The base attaches to a spherical cast piece on top and a plate with large surface at bottom. At the periphery of the spherical cast piece, there is an adjustment disk set composed of the first disk, the second disk and a few screws. At center of the first and second disks, there are holes for the disks to install at the periphery of the cast piece. At the corresponding position, there are several through holes at the first and second disks, so the disks can be connected by at least two positioning screws. The distance between the disks is maintained by positioning screws. Another through hole is for an adjustable screw to tighten or loosen the disks. This is also to adjust the declined angle for the adjustment disk set on the spherical cast piece.

1 Claim, 10 Drawing Sheets

ANGLE-ADJUSTABLE EXERCISER

FIELD OF THE INVENTION

The present invention is related to an exerciser that is suitable to practice swinging for golfing. Especially it is angle adjustable, so the user can simulate the practical golfing condition and improve performance.

BACKGROUND OF THE INVENTION

Golfing has become an inexpensive sport in leisure time. More and more young people are playing golf now. Because the price is going down, the golfing population is going up gradually.

Golfing beginners usually go to practice course to simulate golfing. However, in the practice course, the flat ground is very different from the actual golf course that has slopes and pits and the player has to adjust the pose. Therefore, the practice course cannot provide a desirable simulation effect.

SUMMARY OF THE INVENTION

The objective of the present invention is to provide an angle-adjustable exerciser that can simulate the condition in a real golf course. Depending on personal need, the exerciser can be angle-adjusted to simulate the condition in a real course. So the user standing on the exerciser can achieve improved simulation effect to the condition in a real golf course.

Detailed description for the configuration, features and characteristics for the present invention is given in the following with a preferred embodiment.

DETAILED DESCRIPTION OF THE INVENTION

Figure 1:
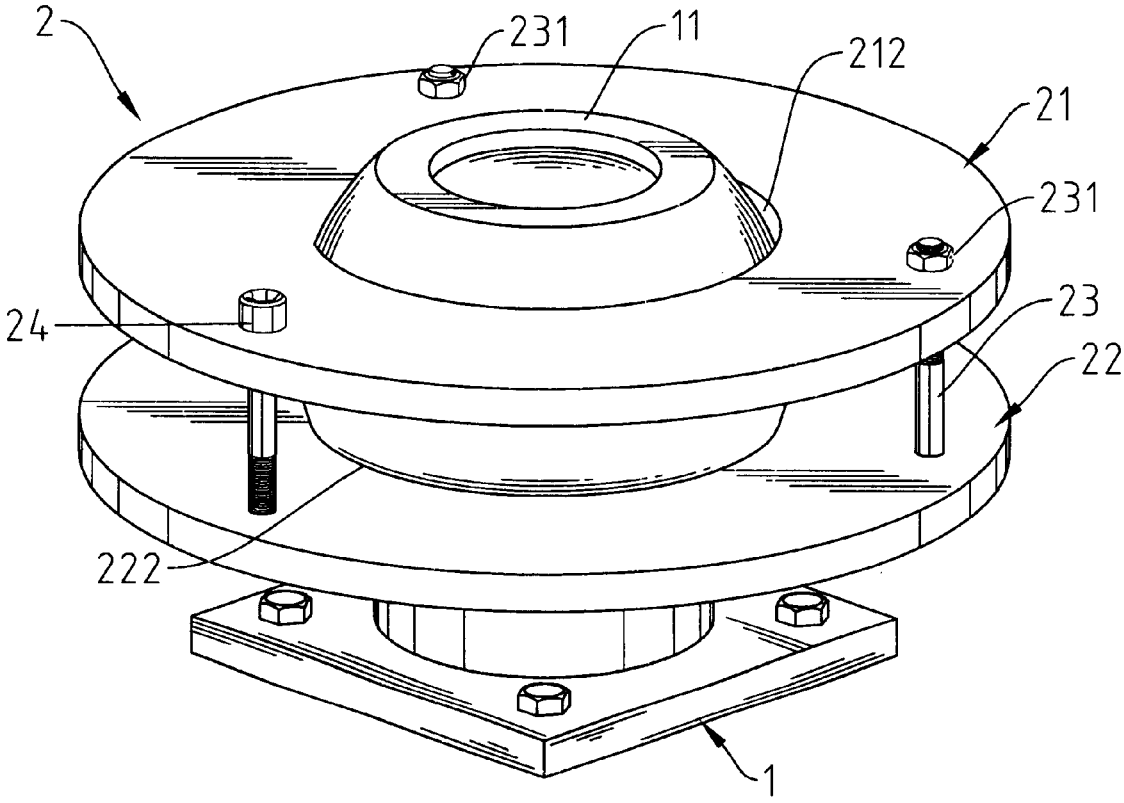
FIG. 1 is a three-dimensional illustration for the present invention.
Figure 2:
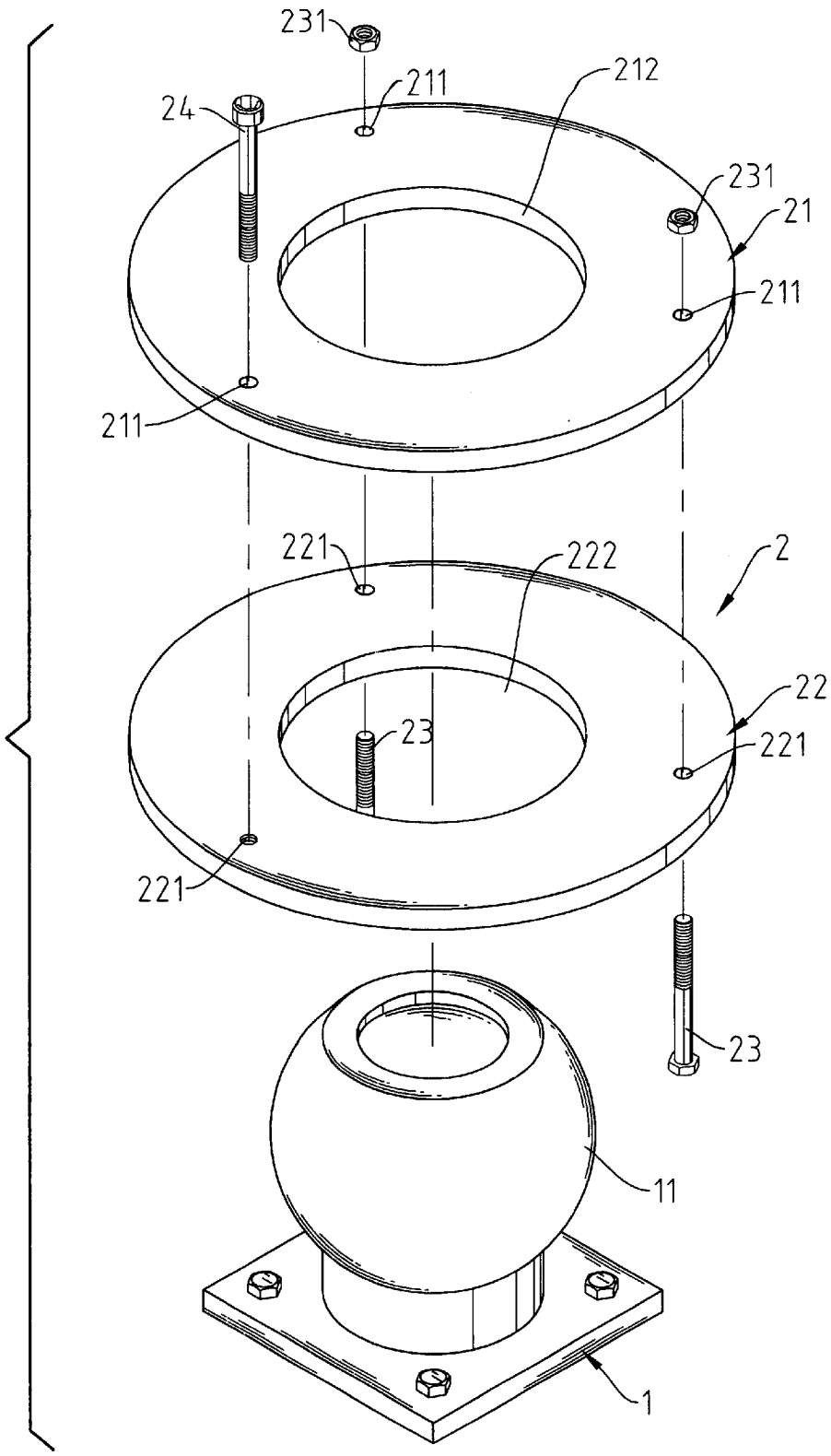
FIG. 2 is a three-dimensional disassembly illustration for the present invention.

Please refer to FIGS. 1 and 2 for the angle-adjustable exerciser for the present invention. It mainly comprises a base 1, an adjustment disk set 2 and a support plate 3. The base 1 attaches to a spherical cast piece 11 on top and a plate 12 with large surface at bottom to support the weight of the base 1. At the periphery of the spherical cast piece 11, there is an adjustment disk set 2.

The above-said an adjustment disk set 2 is composed of the first disk 21, the second disk 22 and several screws 23, 24. At the center of the first disk 21 and the second disk 22, there are holes 212, 222 for the disks to install at the periphery of the cast piece 11 at about ¼ from the edge. At the corresponding position, there are several through holes 211, 221 at the first disk 21 and the second disk 22 (in the figure, there are three holes for each of 211 and 221). The two disks are connected by at least two positioning screws 23 in the through holes 211, 221. Through the nut 231 at the terminal of the positioning screw 23, the two disks are secured and maintained at a constant distance. In another through holes 211, 221 on the two disks, there is an adjustment screw 24. With the two positioning screws 23 lined up, the adjustment screw 24 forms an area to position the two disks. On top of the first disk 21, there is a support plate 3 with large surface area. Below the support plate 3, there are several support rods 31 of certain length to hold the first disk 21. The user can stand on top of the support plate 3. When the support plate 3 moves and declines, the first disk 21 and the second disk 22 of the adjustment disk set 2 can move and decline accordingly at the same time.

Figure 3:
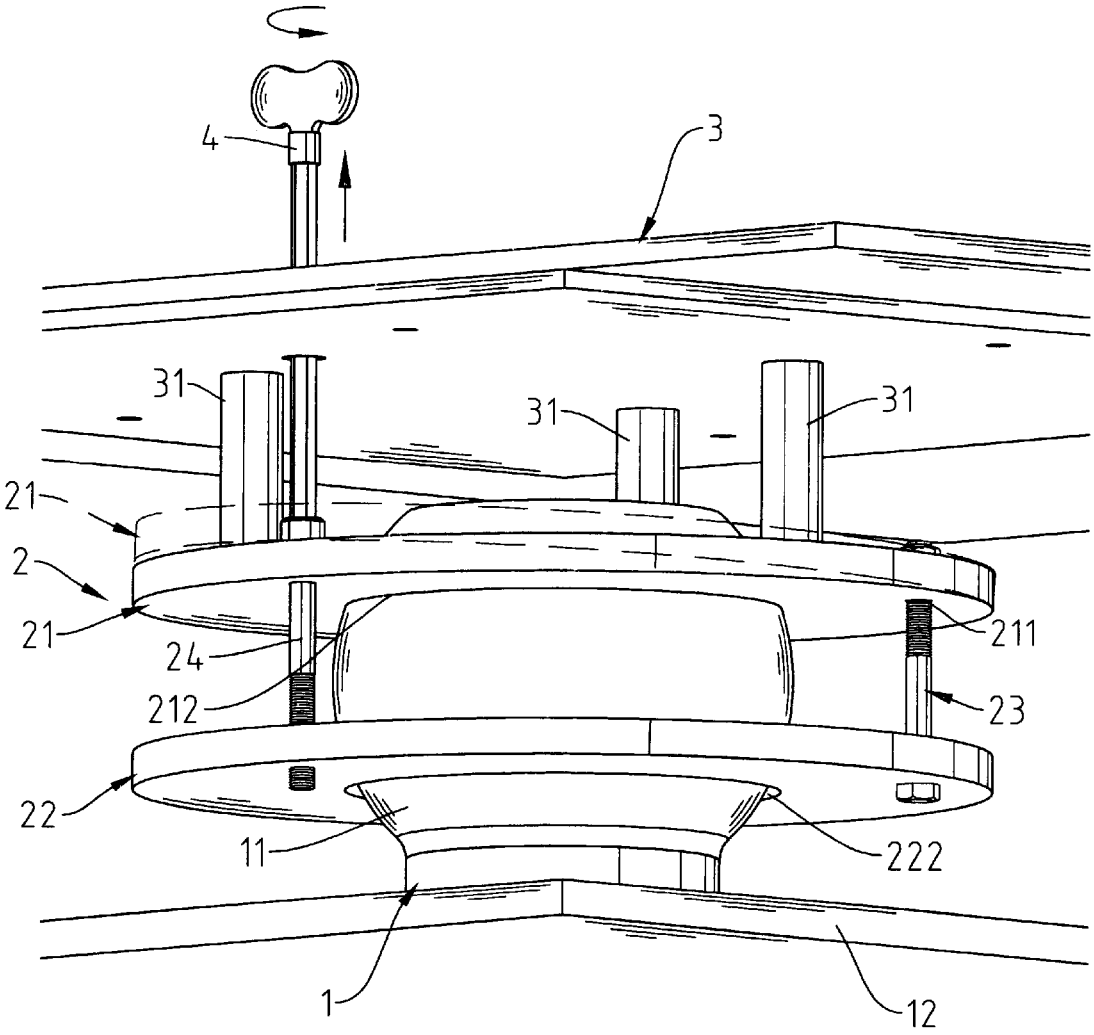
FIG. 3 is a three-dimensional illustration for the adjustment disk set for the present invention.
Figure 4:
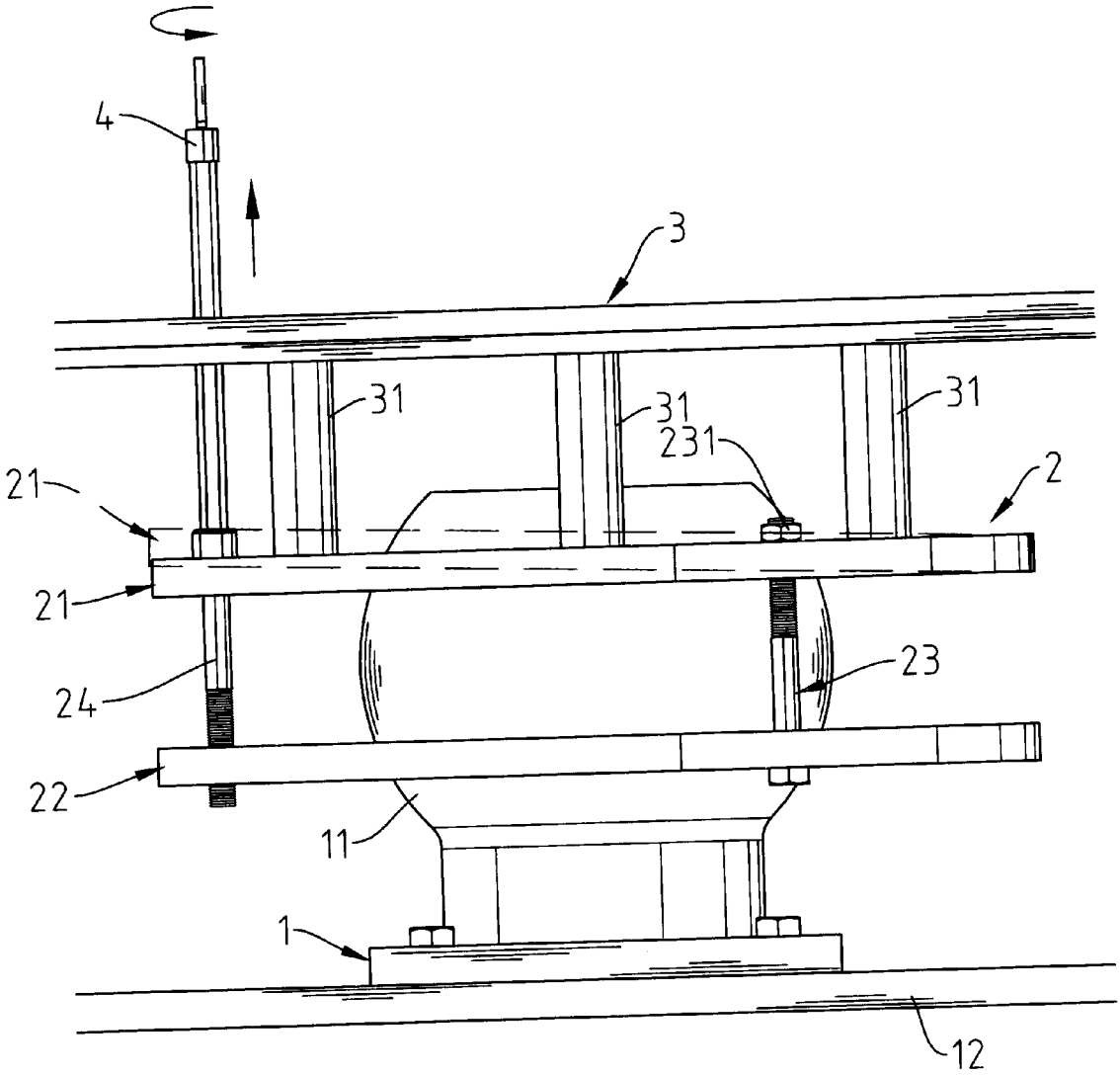
FIG. 4 is a two-dimensional illustration for a loose adjustment disk set for the present invention.
Figure 5:
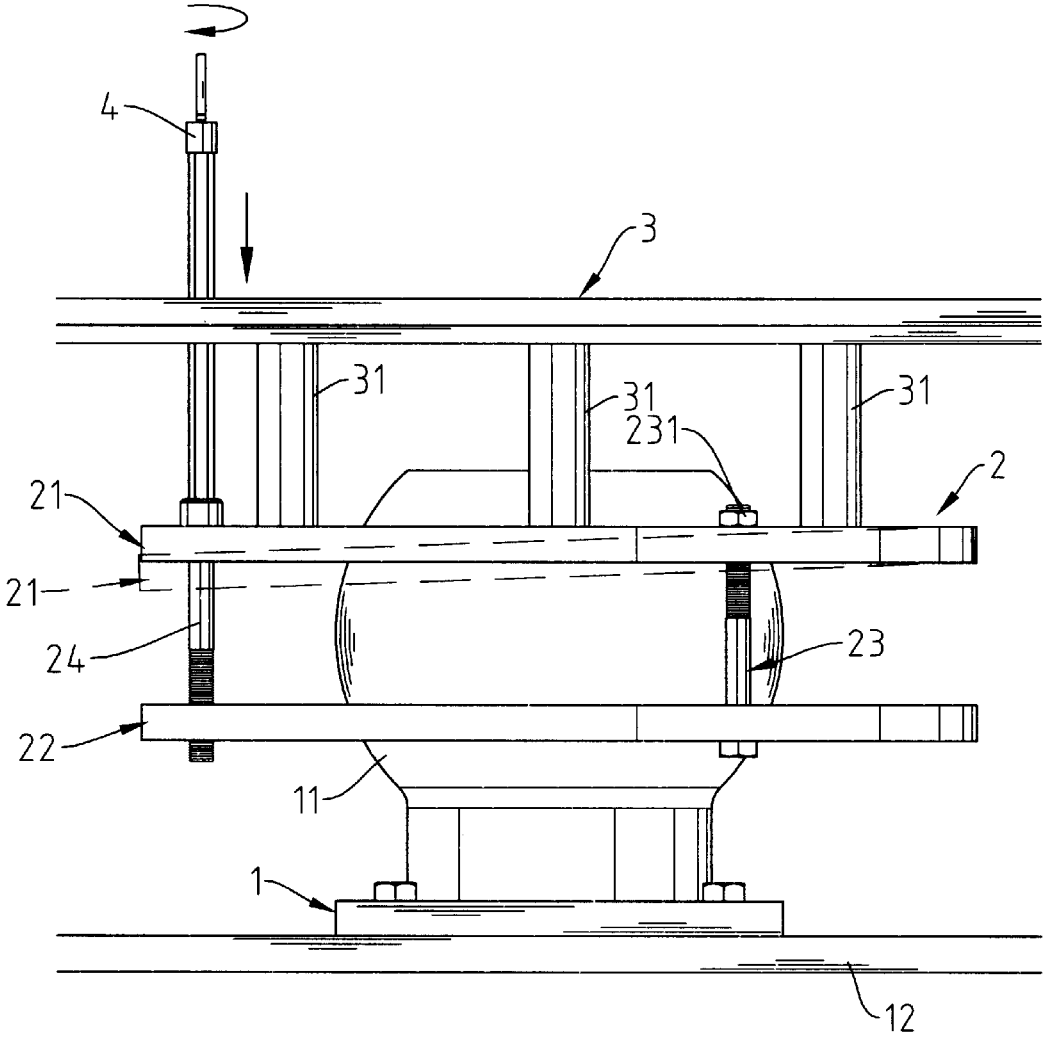
FIG. 5 is a two-dimensional illustration for a tight adjustment disk set for the present invention.
Figure 6:
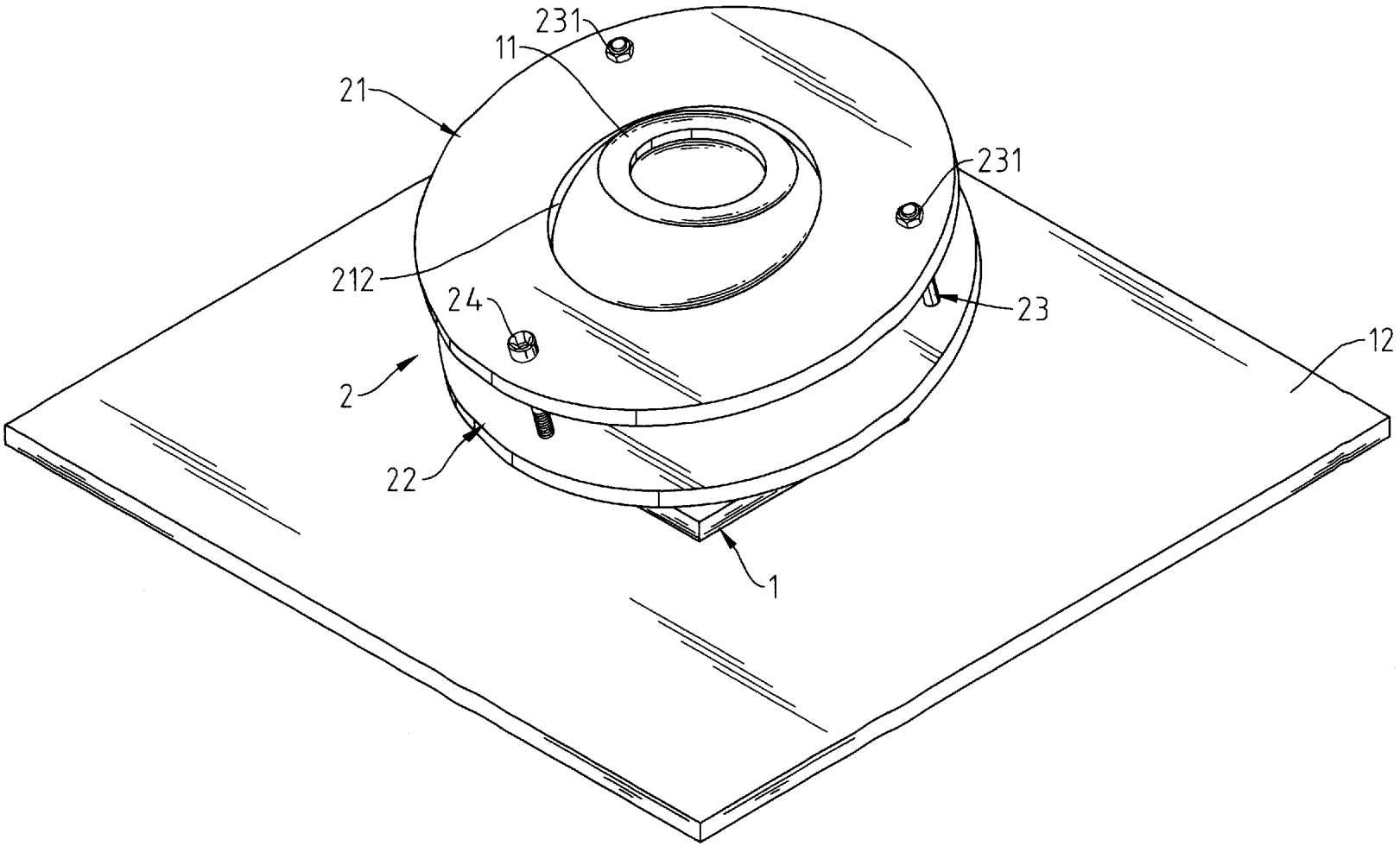
FIG. 6 is the first three-dimensional illustration after angle adjustment for the present invention.
Figure 7:
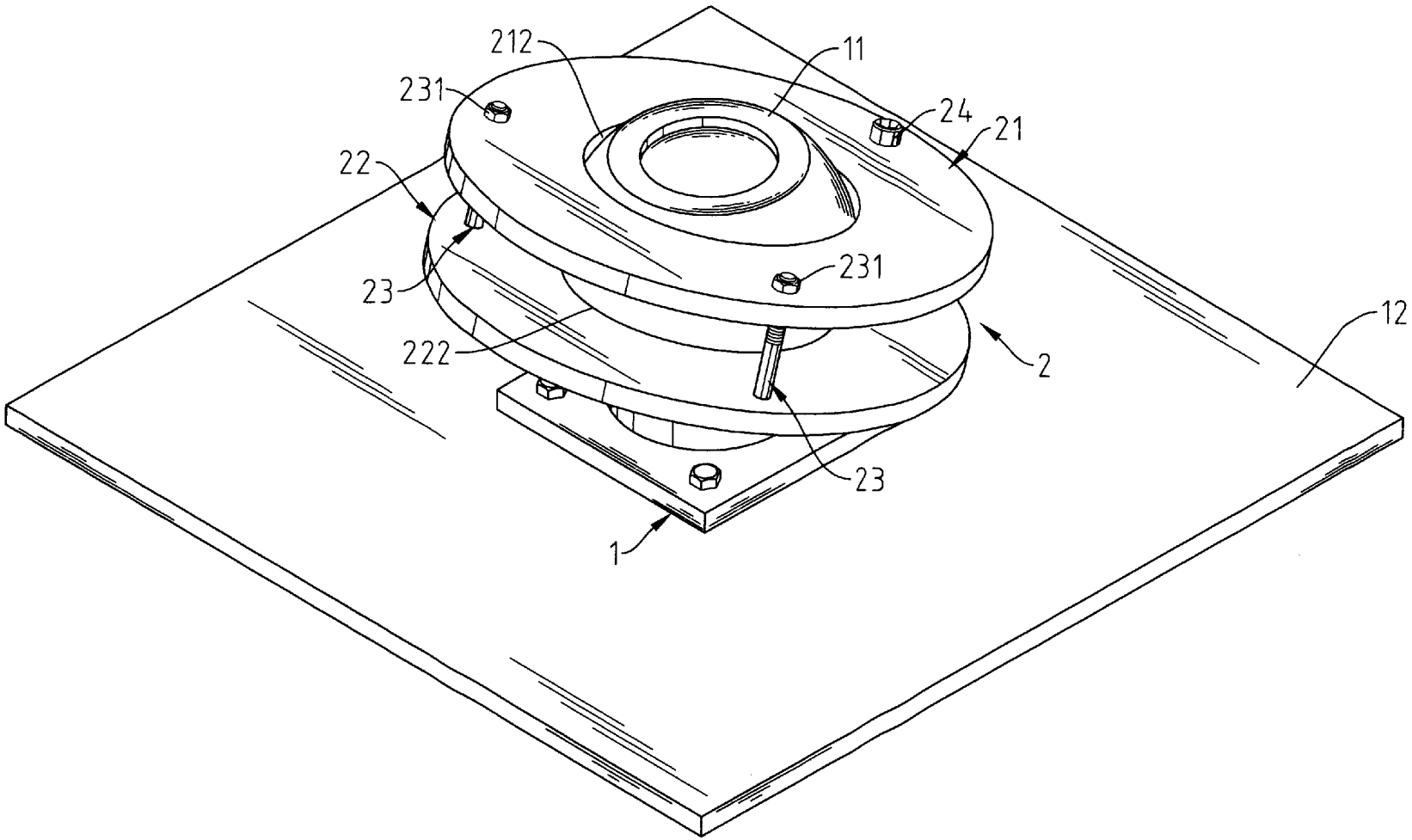
FIG. 7 is the second three-dimensional illustration after angle adjustment for the present invention.
Figure 8:
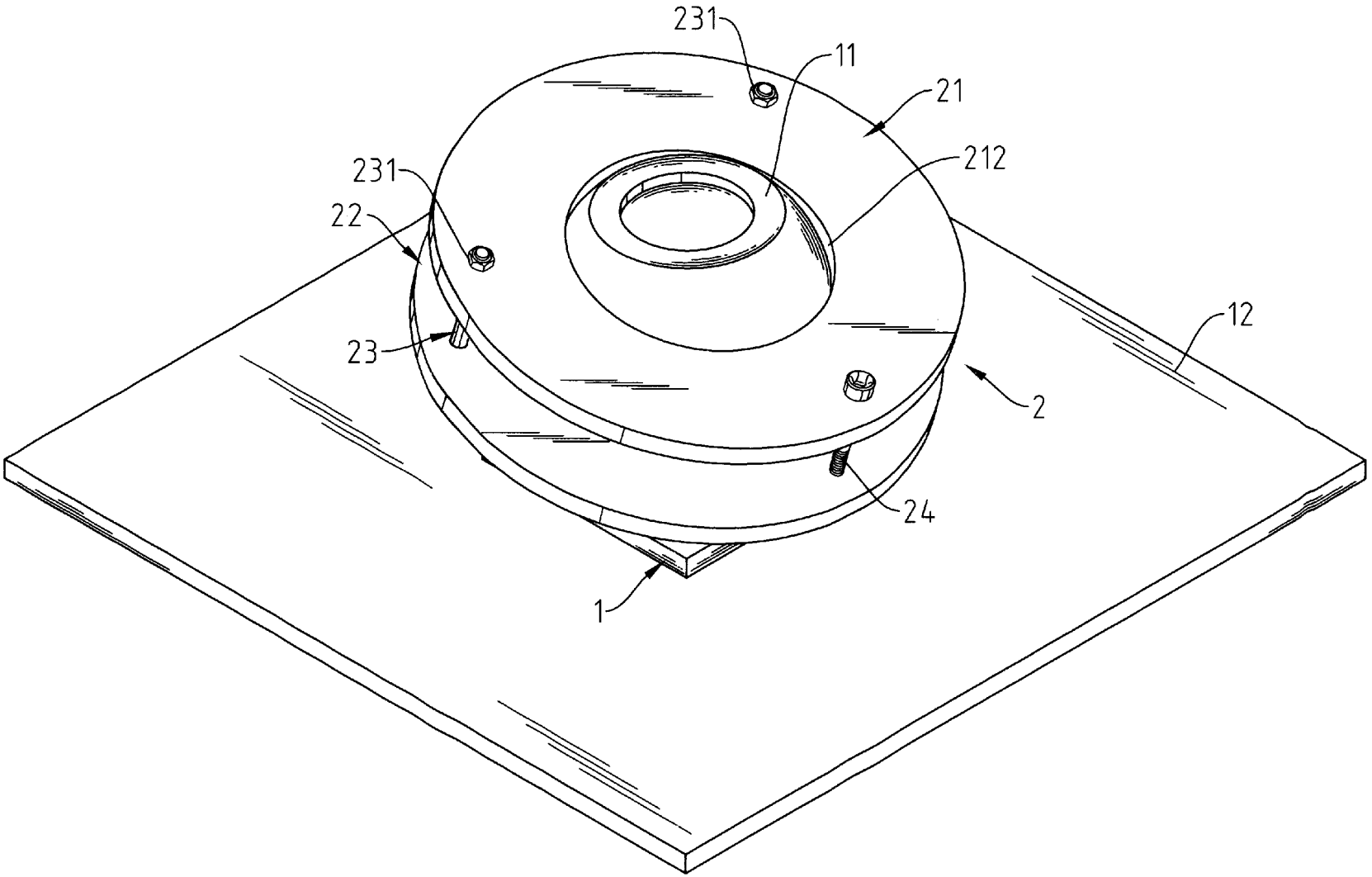
FIG. 8 is the third three-dimensional illustration after angle adjustment for the present invention.

Please refer to FIGS. 3, 4 and 5. The above-said adjustment screw 24 runs downward to secure the disks. Through a hole above the support plate 3, an adjustment tool 4 can stick downward to the adjustment screw 24 and rotate the adjustment screw 24. When the adjustment tool 4 loosens the adjustment screw 24, the gap between the first disk 21 and the second disk 22 goes wider, so no tight connection is maintained with the spherical cast piece 11. As a result, adjustment for the two disks to move forward, backward, left or right can be made with variable angle (refer to FIGS. 6 to 8). After angle adjustment, the adjustment screw 24 on the adjustment disk set 2 is tightened (please refer to FIG. 5). The adjusted disk set 2 is then fixed onto the spherical cast piece 11.

Because the diameter for the through holes 211, 221 on the first disk 21 and the second disk 22 is smaller than the outer diameter of the spherical cast piece 1 1, the installation position for the first disk 21 and the second disk 22 is about ¼ from the edge on the periphery of the castes piece 11. Therefore, the adjustment disk set 2 can fit to the periphery of the spherical cast piece 11 during angle adjustment.

Figure 9:
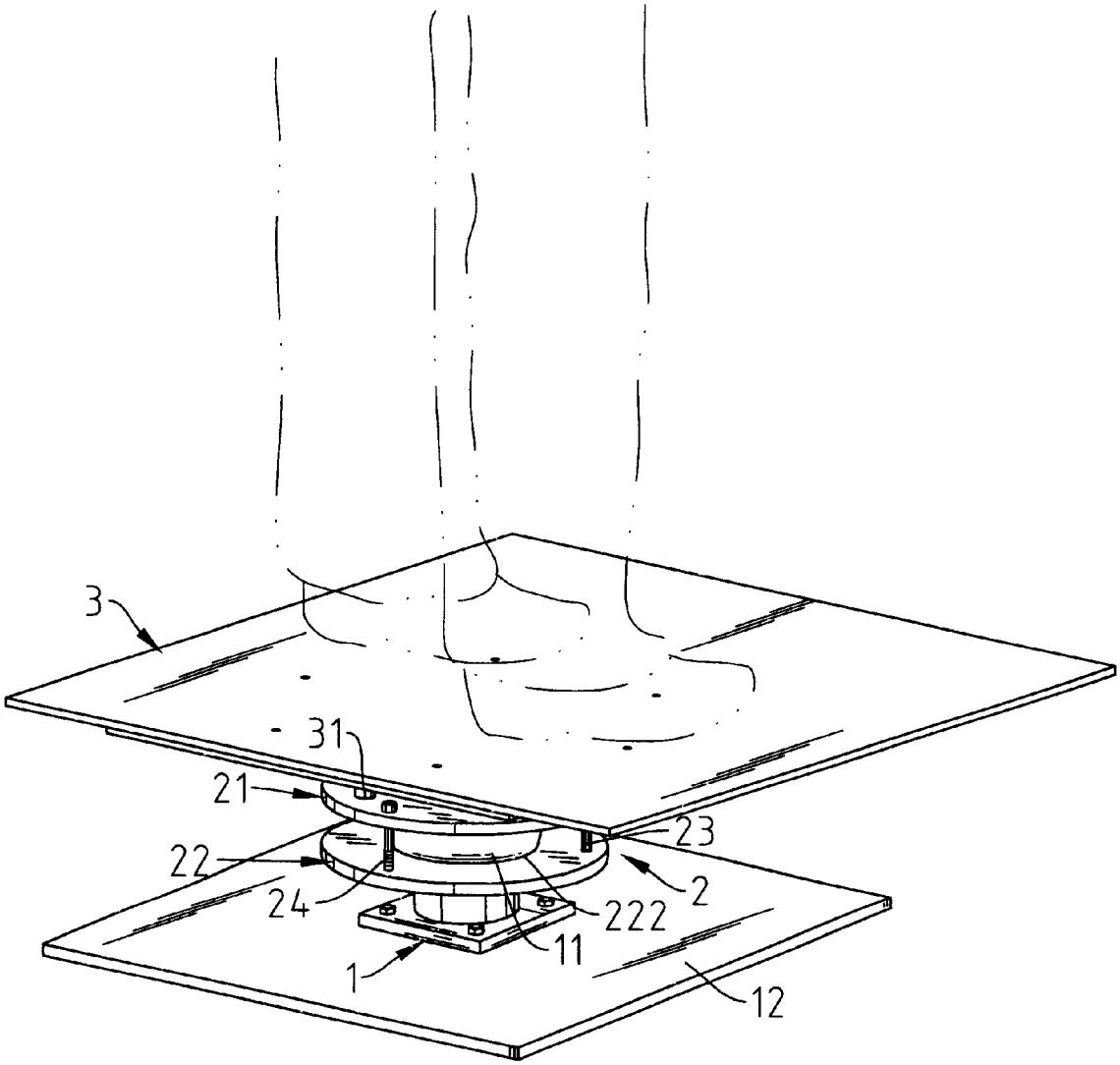
FIG. 9 is the first three-dimensional illustration after angle adjustment for the present invention in practical use.
Figure 10:
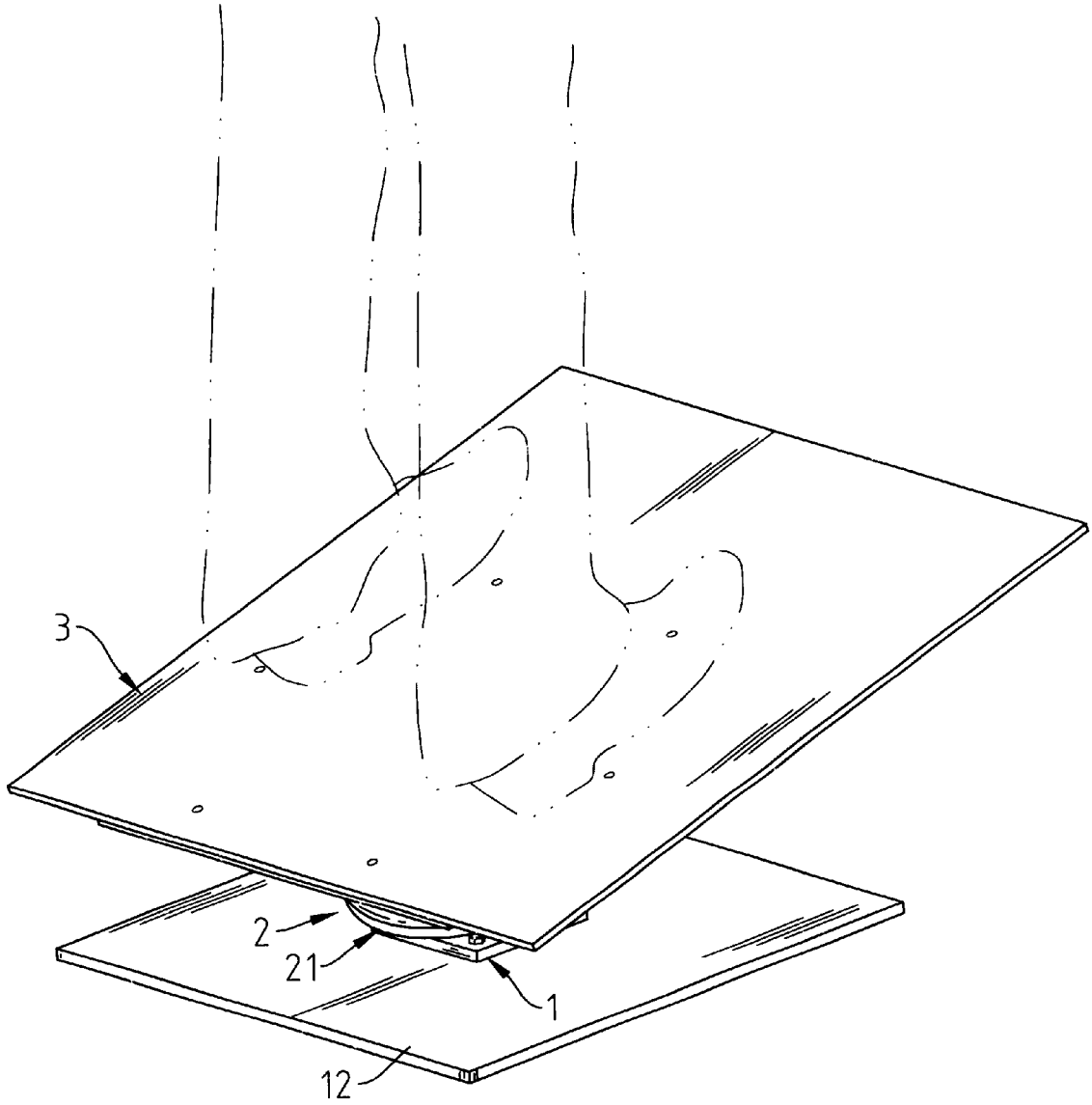
FIG. 10 is the second three-dimensional illustration after angle adjustment for the present invention in practical use.

Please refer-to FIGS. 9 and 10. The present invention is to provide the user with an exerciser that simulates the condition in a real golf course. With the angle adjustment by the adjustment disk 2, the user can stand on the support plate 3 and achieve the simulation effect to the real golf course.

What is claimed is:

1. An angle-adjustable exerciser mainly comprising a base, an adjustment disk set and a support plate, characterized in that:

said base attaches to a spherical cast piece on top and a plate with large surface at bottom, at periphery of said spherical cast piece, there is an adjustment disk set;

said adjustment disk set is composed of a first disk, a second disk and plurality of screws, at center of said first disk and said second disk, there are smaller holes than an outer diameter of said cast piece for said disks to install at periphery of said cast piece, at a corresponding position, there are several through holes at said first disk and said second disk, said two disks are connected by at least two positioning screws and maintained at a constant distance by said positioning screws, another through hole is for an adjustable screw to tighten or loosen said two disks and maintain a desired distance and adjust a declined angle for said adjustment disk secured on said spherical cast piece;

said support plate is a plate with large surface area and contains a plurality of support rods at bottom holding said first disk of said adjustment disk set, so a user can stand on said first disk and operate said adjustment disk set.

* * * * *